US006067737A

United States Patent [19]

Guenther

[11] Patent Number: 6,067,737

[45] Date of Patent: May 30, 2000

[54] APPARATUS AND METHOD FOR HOOPING MATERIAL TO BE EMBROIDERED

[75] Inventor: Ruth P. Guenther, Racine, Wis.

[73] Assignee: Letter Perfect, Inc., Racine, Wis.

[21] Appl. No.: 09/127,272

[22] Filed: Jul. 31, 1998

[51] Int. Cl.[7] ..... D06C 3/08; D05C 9/04

[52] U.S. Cl. ..... 38/102.2; 112/103

[58] Field of Search ..... 38/102, 102.2, 38/102.91; 112/103, 102.4; 33/613; 29/283; 269/37, 47, 58, 909

[56] References Cited

U.S. PATENT DOCUMENTS

| | | | |
|---|---|---|---|
| 4,545,127 | 10/1985 | Barry | 33/613 |
| 4,767,111 | 8/1988 | Guenther . | |
| 4,774,778 | 10/1988 | Williams | 38/102.2 |
| 4,875,268 | 10/1989 | Szarka | 29/283 |
| 5,432,990 | 7/1995 | Seneff . | |
| 5,433,158 | 7/1995 | Moore, III . | |
| 5,590,613 | 1/1997 | Head . | |
| 5,842,430 | 12/1998 | Mack | 38/102.2 X |

OTHER PUBLICATIONS

Selection from *The Perfect Hooper®, Wishbone II®*: Using the 151–000 Bracket Set.

Selection from *The Perfect Hooper®, Wishbone II®*: Using the 160–260 Bracket Set.

Selection from *The Perfect Hooper®, Wishbone II®*: Using the 161–000, 162–000 or 163–000 Bracket Set.

Selection from *The Perfect Hooper®, Wishbone II®*: Using the 171–000 Bracket Set.

Selection from *The Perfect Hooper®, Wishbone II®*: Using the 180–000 Bracket Set.

Selection from *The Perfect Hooper®, Wishbone II®*: Using the 190–000 Bracket Set.

Selection from *The Perfect Hooper®, Wishbone II®*: PH 112–000 Bracket Set for Viking Husqvarna May 28, 1996.

*Primary Examiner*—Ismael Izaguirre

*Attorney, Agent, or Firm*—Michael Best & Friedrich LLP

[57] ABSTRACT

A hooping apparatus and method for accurately orienting and hooping material to be embroidered. The apparatus preferably includes two plates connected in facing relationship by at least one U-shaped connector, and at least one support leg adjustable to support the apparatus in at least two positions. Both plates are preferably provided with a grid of fastener holes for attaching hoops and/or hoop brackets via fasteners to either plate. One plate is preferably rectangular and has a shoulder form which can be removable to change its orientation upon the first plate. The other plate is preferably U-shaped with two substantially flat elongated legs. The apparatus can preferably be placed in at least four positions: a first position in which the support leg is not used and in which the plates are only slightly reclined for draping garments such as jackets, shirts, vests, etc. over the shoulder form and attached plate, a second position in which the support leg is placed in its first position to recline the plates further for hooping the draped garments, a third position in which the support leg is placed in its second position to recline the plates even further for hooping large and/or flat objects such as drapes, sheets, towels, etc., and a fourth position in which the support leg is not used and the apparatus is inverted for hooping operations upon the legs of the U-shaped plate (for objects such as shirt sleeves, pant legs, bags, etc.).

26 Claims, 6 Drawing Sheets

APPARATUS AND METHOD FOR HOOPING MATERIAL TO BE EMBROIDERED

FIELD OF THE INVENTION

The present invention relates to the field of embroidery equipment and methods, and more particularly, to the field of equipment and methods for preparing and hooping material to be embroidered.

BACKGROUND OF THE INVENTION

A common problem encountered in the embroidery process is obtaining a finished embroidery pattern which is both properly located and properly oriented on the embroidered object. In the embroidery process, the embroidered object (which can be a garment, bag, towel, etc.) is "hooped" prior to embroidering. Specifically, the area upon which the desired embroidery is to be placed is located and secured between one hoop positioned beneath the area and another mating hoop positioned above the area and fitted within or around the first hoop. By capturing material between the hoops in this manner, the area to be embroidered is kept taut, flat, and secure during the embroidering process. Typically, one of the two hoops is provided with a fitting or jig which is secured to an embroidery machine to fix the hoop and hooped material in place in the embroidery machine.

The hooping step just described is perhaps one of the most important in the embroidery process, because incorrectly hooped objects can result in (among other undesirable results) embroidery patterns which are located improperly on the object or which are rotated in their desired location upon the object. However, because there exist so many different objects which are regularly embroidered, identifying a positioning and orienting apparatus or method which works well for many objects has been an elusive goal. Though hooping devices exist for hooping several different objects, such devices typically fail to perform well for all of the objects. For example, to properly locate and orient an embroidery pattern upon the upper left chest of a sweater, it is not sufficient to hoop the sweater as it lays on or against a level surface such as a table. Since the location and orientation of the pattern is significantly different when worn than when on the level table-like surface, it is necessary to perform the hooping operation when the sweater is draped in its normally worn position. Hooping devices which address this need are usually not well suited to orient and hoop shirt sleeves or pant legs for the hooping process. One example of such a device is disclosed in U.S. Pat. No. 4,767,111, the teachings of which are incorporated herein by reference with regard to the framing and hooping of garments such as shirts, jackets and other shirt-like garments. Similarly, hooping devices which are used for orienting and hooping large flat items such as towels and sheets or for embroidering large patterns are often not well suited to orient and hoop jackets, pant legs, or shirt sleeves.

As an example of how hooping devices which are well designed to properly orient and hoop one type of object are typically not suitable for performing the same tasks on another type of object, reference is made hereby to U.S. Pat. No. 4,767,111 (mentioned above), hereinafter referred to as the "'111 patent". The device disclosed in the '111 patent is designed to orient and hoop garments worn over the torso, such as shirts, jackets, windbreakers, and vests. To properly orient the garment on the device, a user first places the workboard of the device in an upward garment-mounting position, and then places the garment to be hooped over the workboard. The workboard is then placed in a lower position in which the hooping process is performed. By orienting the garment in the upper position, the garment hangs as it would on a wearer, and is properly oriented for embroidering. Unfortunately, though the device disclosed in the '111 patent is well-suited for orienting and hooping garments to be worn on the torso, the large shape of the workboard is not well-suited for embroidering pant legs or shirt sleeves. Also, though the device disclosed in the '111 patent has a large work space (which is required for orienting and hooping many objects), the positions which the device can assume are limited to angles which are too steep to place many objects without causing the objects to slip down the workboard. Therefore, the device disclosed in the '111 patent, though designed and well-suited for orienting and hooping particular objects, is not well suited to perform the same operations on other objects.

For industrial users of hooping devices which are specifically designed for embroidering particular objects, having a number of various devices for orienting and hooping a variety of different objects makes economic sense. Specifically, for objects which are embroidered in large numbers, an orienting and hooping device which is specifically designed and tailored for that particular object can save a significant amount of time and money due to its specific design. However, the use of a number of different orienting and hooping devices (one for each object type) is impractical for users which do not mass-produce embroidered objects. Such users include home embroiderers, users who offer custom embroidery services who vary significantly from job to job, or users who produce a large number of different embroidered products in small quantities. These users are either left with the option of purchasing a number of hooping devices which are well-designed for orienting and hooping specific objects, or the option of using a hooping device which can be used for orienting and hooping a number of objects but which does none of them well. The first option is unacceptably expensive for most of such users. Furthermore, having a number of such devices requires a large amount of storage space. With the recent popularity of many sophisticated home embroidery systems, and as the desire for similar quality in hooping devices increases, the second option is becoming increasingly unacceptable.

Therefore, there exists a need for an apparatus and method for hooping material to be embroidered which performs this function on a number of different objects with quality comparable to devices specifically designed for each such object. Such an apparatus would be compact and easy to set up without significantly sacrificing the ease by which the orienting and hooping method is performed. The present invention provides such an apparatus and method.

SUMMARY OF THE INVENTION

The hooping apparatus of the present invention preferably comprises two plates connected in a substantially facing relationship by at least one connector and at least one support leg which supports the hooping apparatus in at least two positions. A first plate is preferably a rectangular plate with a shoulder form located on a top end thereof. The shoulder form preferably has two upwardly converging edges or surfaces which underlie the shoulders of a garment draped thereover, and preferably can also have front and rear shapes to simulate the upper front and upper back surfaces of a wearer, respectively. The shoulder form can be integral with the first plate, a separate part attached to the first plate, or a separate part removable and re-positionable upon the first plate to reverse the positions of the front and rear shapes upon the first plate (allowing for more exact hooping operations to be performed upon a garment).

Preferably, the second plate is U-shaped, with two elongated flat legs extending in a side-by-side fashion from a connected area. The connectors connecting the first plate to the second plate are also preferably U-shaped, having legs attached to the facing surfaces of the first and second plates and connecting portions which extend between the first and second plates. One or both ends of the second plate's elongated flat legs can be shaped to match or drape objects placed thereover (such as having tapers over which the shoulders of infantwear may be draped). To minimize obstruction between the first and second plates, the bases of the U-shaped connectors are preferably located near the same adjacent edge of the first and second plates.

Both plates preferably have a number of holes which are shaped and sized to receive fasteners which secure hoops and hoop brackets upon the plates for subsequent hooping operations. The holes are preferably located across substantially the entire surface of the plates, and are preferably arranged in grid form. To assist in orienting objects upon the plates, the plates preferably have alignment marks upon their surfaces (e.g., grooves, lines, etc.).

Also preferably, the hooping apparatus has at least four working positions in which the apparatus rests in a stable manner upon a surface (such as a desk, a table, a counter, etc.). In the first working position, the two plates are oriented in a slightly reclined position and the support leg is not used. The hooping apparatus preferably rests in the first working position upon adjacent edges of the two plates, but can also (or instead) rest upon the connectors or parts of the connectors and parts of the plate edges. The substantially upright orientation of the first and second plates in the first working position permits a user to drape garments to be worn on the torso (e.g., jackets, shirts, sweaters, etc.) over the first plate and the shoulder form to properly position such garments in their normally-worn position. In the second working position, the support leg is inserted on the hooping apparatus (preferably on the lower of the two plates via a first slot) and supports the hooping apparatus in a more reclined position than in the first working position. The second working position permits a user to install a hoop on a garment which was draped in the first working position. In the third working position, the support leg supports the hooping apparatus a position which is even more reclined than the second working position. This third working position is preferably used when a large work surface is needed to hoop objects such as sheets, drapes, towels, etc. which would otherwise slip or slide off of the first plate in the first and second working positions. The third working position is still inclined sufficiently, however, to permit a user to comfortably perform hooping operations upon the first plate. It should be noted that garments to be worn on the torso (e.g., jackets, shirts, sweaters, etc.) can be draped in any of the above-described positions. Finally, in the fourth working position, the hooping apparatus is placed in an inverted position upon the surface, with the lower (second) plate from the second and third working positions being positioned above the upper (first) plate. In the fourth working position, the elongated flat legs of the second plate are positioned face up on the hooping apparatus, and are preferably inclined slightly away from the user for comfort. The elongated flat legs of the second plate can be used to perform hooping operations on shirt sleeves, pant legs, large and small bags, infant wear, etc.

The design and arrangement of the hooping apparatus according to the present invention permits a user to comfortably perform hooping operations on a number of objects which would otherwise require separate hooping devices. Also, the design and arrangement of the present invention is space saving and even permits the use of some hoops on certain objects (e.g., tubular hoops on pant legs or shirt sleeves) which are not fully securable upon conventional hooping devices.

More information and a better understanding of the present invention can be achieved by reference to the following drawings and detailed description.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF PREFERRED EMBODIMENTS

Figure 1:
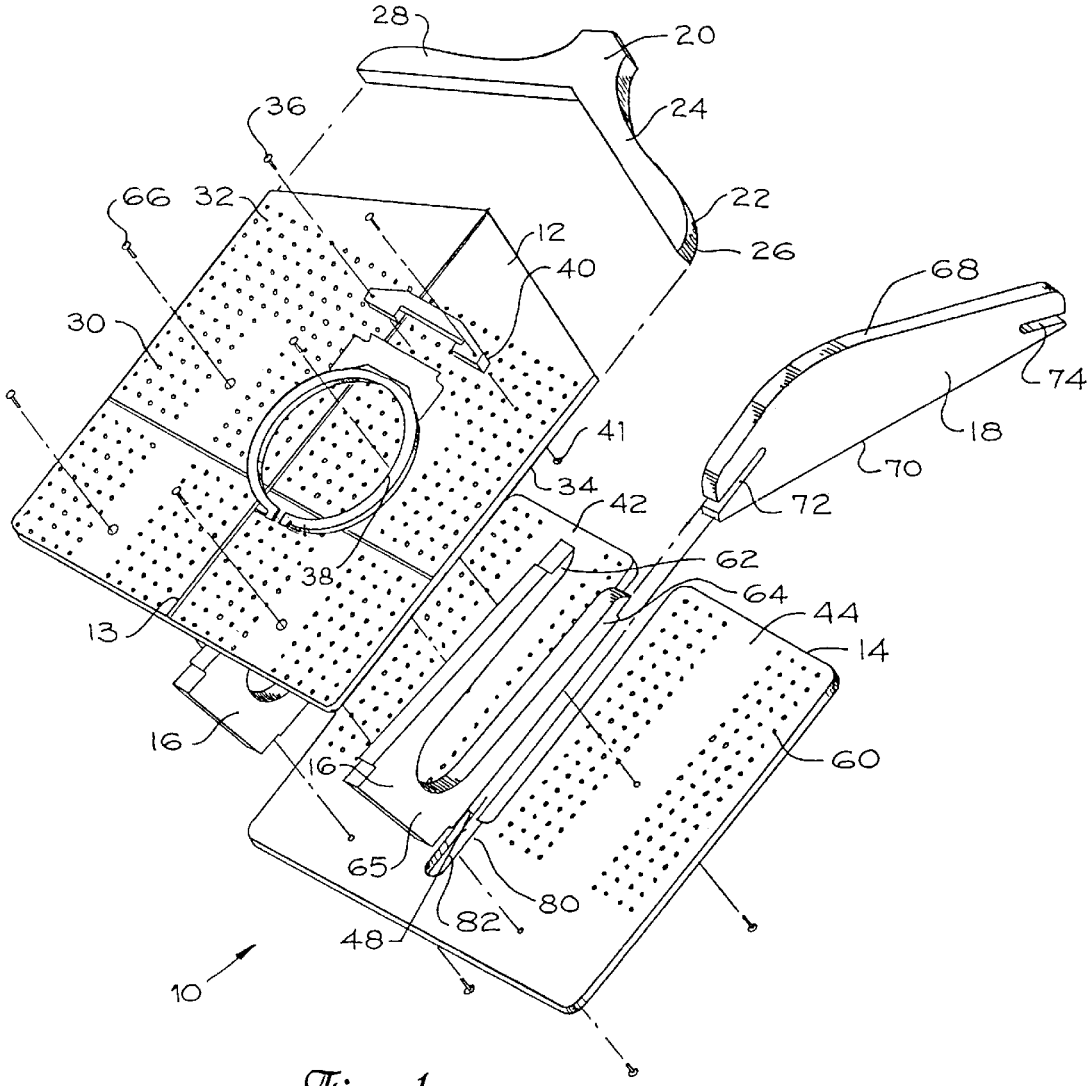
FIG. 1 is an exploded perspective view of a first preferred embodiment of the hooping apparatus according to the present invention.

A first preferred embodiment of the present invention is illustrated in FIGS. 1–5. As best shown in FIG. 1, the hooping apparatus of the present invention (designated generally at 10) preferably comprises four basic elements: an upper plate 12, a lower plate 14, two connectors 16, and a support leg 18. The upper plate 12 is used for orienting and hooping large objects such as towels, sheets, drapes, etc. and for orienting and hooping garments worn over the torso, such as shirts, jackets, windbreakers, vests, etc. The lower plate 14 is used for orienting and hooping smaller objects such as pant legs, sleeves, large and small bags, infant and toddler wear, etc.

The upper plate 12 is preferably provided at one end with a shoulder form 20 over which garments to be worn on the torso are draped for hooping. The shoulder form 20 preferably has a pair of opposing sloped upper surfaces 22 which underlie the shoulders of a garment placed thereover. Also, the shoulder form 20 preferably has a front surface 24 and a rear surface 26 which underlie the front and rear shoulder portions, respectively, of a garment placed over the shoulder form 20. Because the upper area of a user's front and back is sloped differently in the vertical direction, it is preferable that the front surface 24 of the shoulder form 20 takes the sloped shape of either the front or the back of a user, depending upon which surface of garments (front or back) the user desires to regularly perform embroidery. For purposes of illustration, the particular shoulder form 20 shown in FIGS. 1–5 is a front shoulder form, while the shoulder form 120 shown in FIG. 6 (see the second preferred embodiment of the present invention described below) is a back shoulder form.

It should be noted that the shoulder form 20 described above and illustrated in the Figures is only one possible shoulder form embodiment. For example, the shoulder form 20 can be of varying thicknesses ranging from a thickness less than the upper plate 12 to which it is attached to a thickness several times larger. The shoulder form 20 can even be defined by opposing sloped upper edges of the upper plate 12. Also, the shoulder form 20 need not be one piece such as that shown in the Figures, but can instead be a multiple-piece device having at least two opposing sloping surfaces or edges to underlie the shoulders of a garment. For example, the shoulder form 20 can consist of two enlarged members which are similar in shape to the legs 28 of the shoulder form 20 shown in the Figures but which do not meet at the top of the upper plate 12. In this regard, the shoulder form 20 need not be a separate unit permanently or removably attached to the upper plate 12. Instead, the shoulder form 20 can be an integral part of the upper plate 12 and/or a part of the upper plate 12. Additionally, the particular outline of the shoulder form 20 need not necessarily take the shape shown in the Figures. For example, the curved edges of the shoulder form 20 can instead be angled. Though the curved front and rear surfaces 24, 26 of the shoulder form 20 are preferably shaped to match the drape of a garment over a user's upper front and back torso, these particular shapes are not necessary to practice the present invention. For example, the front and rear surfaces 24, 26 of the shoulder form 20 need not have any curve to them at all. At a minimum, the shoulder form 20 (if used) should have at least two opposing sloping surfaces or edges which underlie the shoulders of a garment placed thereover. Finally, it will be appreciated by one having ordinary skill in the art that the shoulder form 20 can be made from a number of different materials such as wood, metal, plastics, composites, stone, ceramics, glass, rubber, etc. or combinations thereof, and can have a number of different finishes, including but not limited to smooth, rough, ribbed, tacky, and dimpled finishes.

The upper plate 12 is preferably rectangular in shape and preferably has a number of holes 30 therethrough for passing fasteners 36 between the front side 32 and the back side 34 of the upper plate 12. Such fasteners 36 (shown by way of example in FIG. 1) are of any number of types well known to those skilled in the art used for securing hoops 38 directly or via brackets 40 (both also shown by way of example in FIG. 1) to a surface during the hooping process. Typically, such fasteners 36 are threaded fasteners such as screws or bolts with mating nuts 41, or are pins (not shown) which rest in matching holes in the brackets 40 and holes 30 within the upper plate 12. However, many other types of fasteners well known to those skilled in the art can be used.

In order to properly align the hoops 38 on the front side 32 of the upper plate 12 using the fasteners 36 and brackets 40 as desired, the holes 30 are preferably arranged in a grid formation almost completely covering the upper plate 12. Preferably, a ⅝" (0.625 inch; 15.9 mm) horizontal and vertical spacing exists between the centers of the holes 30 which are 1/16" (0.0625 inch; 1.6 mm) in diameter. Of course, larger or smaller holes 30 having different shapes, which are spaced differently, and/or in a different pattern are possible. The exact size and shape of the holes 30 depend upon the type of fasteners 36 used on the hooping apparatus 10. In fact, since many different conventional fastener types exist for securing a hoop 38 to the upper plate 12, it is possible for the holes 30 not to extend fully through the upper plate 12, and for the fasteners 36 to be secured within the holes 30 in various ways (e.g., screw into threads formed within the holes 30, be press fit within the holes 30, etc.). Also, the spacing and pattern of the holes 30 depend upon the type of hoops 38 and brackets 40 (if any) used with the hooping apparatus 10, as well as the number of desired locations to which the hoops 38 used with the present invention can be placed and secured. Each such arrangement of hole type, size, spacing, and pattern falls within the spirit and scope of the present invention.

The upper plate 12 is preferably made of a rigid material such as wood, plastic, metal, glass, composites, stone, ceramics or a combination of the same. Most preferably, the upper plate 12 is made of plastic. The upper plate 12 can even have hollow areas to reduce weight. In order to provide for the easy draping and removal of objects upon the upper plate 12, the upper plate 12 preferably has a smooth finish. However, it will be noted that other finishes are possible, such as a rubberized, ribbed, dimpled, or rough finish (for, e.g., reduced slippage of an object on the upper plate 12).

In order to assist in the alignment of objects on the hooping apparatus 10, one or more vertical and/or horizontal alignment marks 13 can be provided on the front side 32 of the upper plate 12. These alignment marks 13 are preferably lines extending across the front side 32. However, dots, dashes, crosshairs, or other alignment indicia can instead be used. The alignment marks 13 can be made in any number of ways and can take any number of forms well known to those skilled in the art. By way of example only, the alignment marks 13 can be printed, etched, burned, painted, pressed, stained, etc. or can take the form of decals or glued objects upon the front side 32. It should be noted that the alignment marks 13 can instead or additionally be projected (via lasers or otherwise) upon the front side 32 of the upper plate 12. Also, especially where the upper plate 12 is made of a transparent or semi-transparent material, the alignment marks 13 can be projected from behind the upper plate 12. With such upper plate materials, it is even possible to provide one or more lights (in the form of neon tubing, miniature lights, light filaments, etc.) which are behind the upper plate or are integral with or inside the upper plate.

Figure 5:
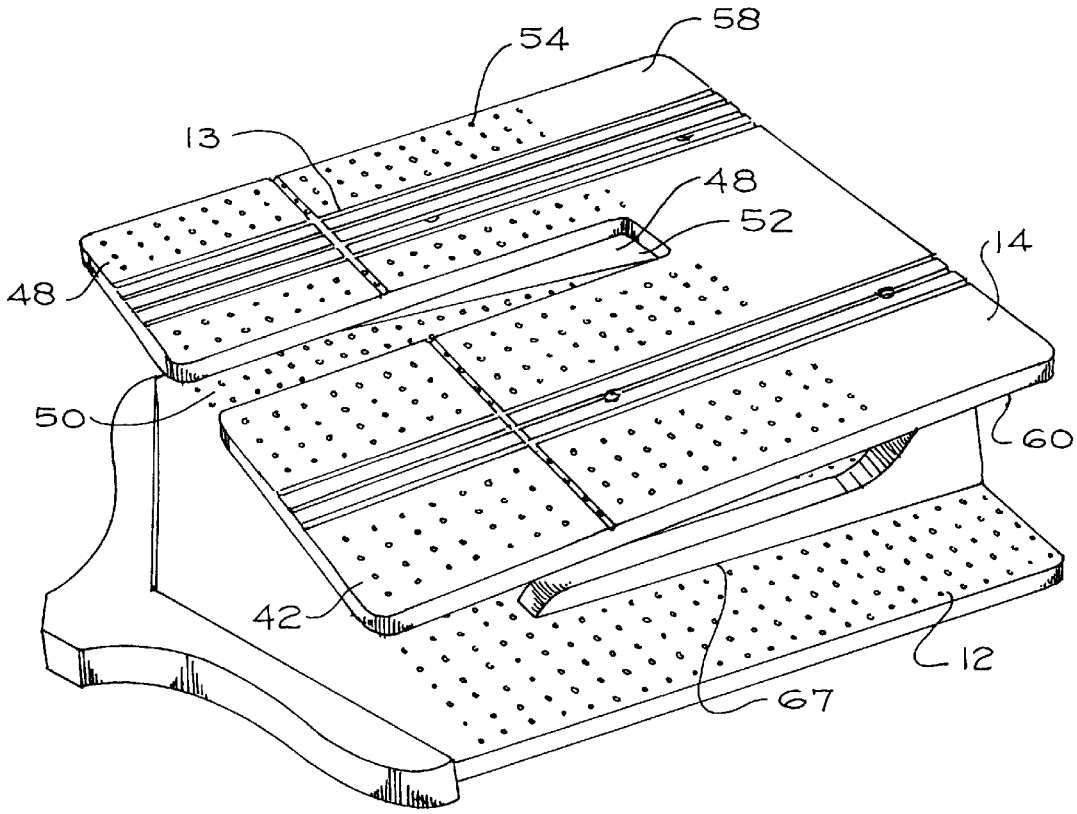
FIG. 5 is an assembled perspective view of the present invention shown in FIG. 1, with the apparatus in a fourth position.

As best seen in FIG. 5, the lower plate 14 is preferably a non-symmetrical U-shaped plate having a wide leg 42 and a narrow leg 46 separated by a groove 48 which is open at one end 50 and closed at an opposite end 52 within the interior of the lower plate 14. Like the upper plate 12, the lower plate 14 is preferably provided with a number of holes 54 therethrough for passing fasteners 36 (discussed above) between the front side 58 and the back side 60 of the lower plate 14. The types of fasteners 36, holes 54, hole locations, sizes, shapes and patterns, the material and finish, and the desired alignment marks 13 of the lower plate 14 are substantially the same as that described above for the upper plate 12, with the exception of the possible hole patterns being different due to the U shape of the lower plate 14. Preferably, the overall height and width of the lower plate 14 is substantially the same as that of the upper plate 12, but can instead be smaller or larger as desired. The ends of the wide leg 42 and the narrow leg 46 are shown in the Figures as being substantially rectangular. However, this shape can vary depending upon the desired uses of the hooping apparatus 10. One or both of the ends of both legs 42, 46 can be tapered, rounded, pointed, etc. to facilitate easy orientation and draping of objects thereover. For example, where a user desires to drape or orient an infant's shirt over one of the legs 42, 46 for hooping, the legs 42, 46 can be tapered (not shown) to provide shoulder supports for the garment.

The upper plate 12 is preferably attached to the lower plate 14 by two U-shaped connectors 16. Each U-shaped connector 16 preferably has two legs 62, 64 connected by middle portions 65. The legs 62, 64 of each connector 16 are preferably attached in a conventional manner to the back sides 34, 60 of the upper and lower plates 12, 14, respectively. Specifically, the legs 62, 64 are preferably attached to the back sides 34, 60 of the upper and lower plates 12, 14 by threaded fasteners 66 which are preferably passed through the upper and lower plates 12, 14 and then into the legs 62, 64 as shown in FIG. 1. To better secure the connectors 16 to the upper and lower plates 12, 14, grooves 67 are preferably provided in the back sides 34, 60 of the upper and lower plates 12, 14. The grooves 67 are preferably shaped to match the footprint of the legs 62, 64 upon the back sides 34, 60 of the upper and lower plates 12, 14, respectively. Other conventional manners of attaching the connectors 16 to the upper and lower plates 12, 14 (such as by gluing, nailing, welding, etc.) are well known to those skilled in the art, and are not therefore discussed further herein.

Preferably, the legs 62 of both connectors 16 which are attached to the upper plate 12 meet the middle portions of the connectors 16 at a slightly acute angle (e.g., 77 degrees), while the legs 64 of both connectors 16 which are attached to the lower plate 14 meet the middle portions of the connectors 16 at a slightly obtuse angle (e.g., 98 degrees). In this manner, when the hooping apparatus 10 is placed on a flat surface in its fully upright position shown in FIG. 2, the upper plate 12 and the lower plate 14 assume a slightly reclined position. Preferably in this position, the upper plate 12 is 13 degrees from a fully vertical position, while the lower plate 14 is 8 degrees from a fully vertical position. As described in more detail below, the particular angles just described facilitate a number of inclined positions for the hooping apparatus 10 when in its various positions shown in FIGS. 2–5. Though the angles just described are most preferred, the present invention can be practiced with any combination of the same or different angles. Specifically, although the plates 12, 14 are most preferably angled with respect to one another by 5 degrees, other angles defined between the plates 12, 14 are possible, ranging from 0 degrees (parallel plates) to 90 degrees (perpendicular plates). By "substantially facing" one another, the plates 12, 14 are angled with respect to one another between and including 0 degrees and 90 degrees. Preferably, however, the plates 12, 14, are angled with respect to one another by between 2 and 45 degrees, and more preferably between 3 and 10 degrees. Likewise, each most preferred specific angle described above (the 77 degree and 98 degree angles between the plates 12, 14 and the legs 62, 64, and the 8 degree and 13 degree angles of the plates 12, 14 from a fully vertical position) can vary considerably. Any of these angles can vary from 0 degrees to 90 degrees. However, these angles more preferably fall within plus or minus 10 degrees of the specific angles noted.

To provide the maximum working space possible between the upper plate 12 and the lower plate 14, the width and thickness of the legs 62, 64 are preferably as thin as possible without sacrificing the structural integrity of the hooping apparatus 10 for normal working operations. Therefore, the U-shape of the connectors 16 is preferably pronounced, with long legs 62, 64 and a deep mouth between them. As an alternative to the use of two connectors 16, one, three, or even more connectors 16 can be employed having different thicknesses and shapes than those shown in the Figures. It will be appreciated by one having ordinary skill in the art that the connectors 16 shown in the Figures and described above are only one possible type and shape used to connect the upper plate 12 to the lower plate 14 while still maintaining a sufficient work area between the plates 12, 14 (preferably, a substantially unobstructed area between the plates 12, 14). For example, the plates 12, 14 can be connected by one or more posts, blocks, walls, etc. secured at opposite ends by fasteners (such as screws) passed through the plates.

Figure 3:
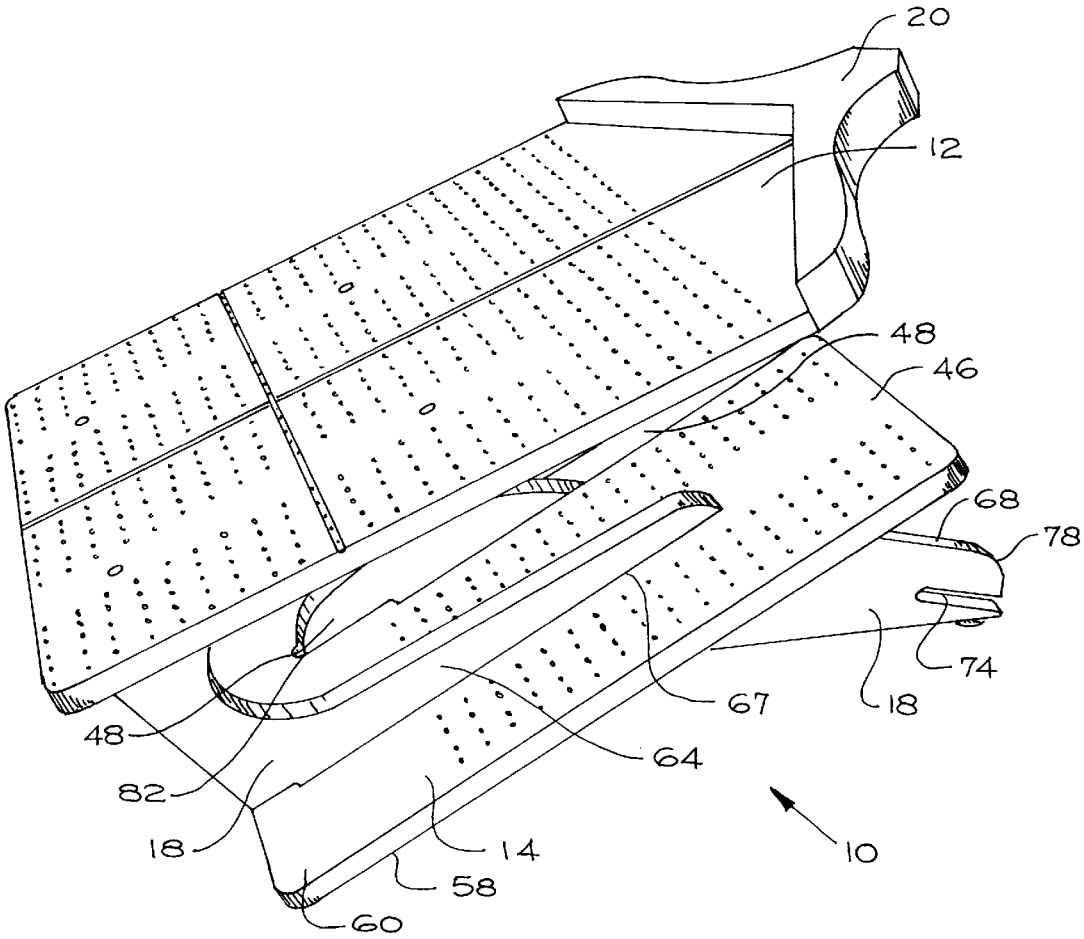
FIG. 3 is an assembled perspective view of the present invention shown in FIG. 1, with the apparatus in a second position.
Figure 4:
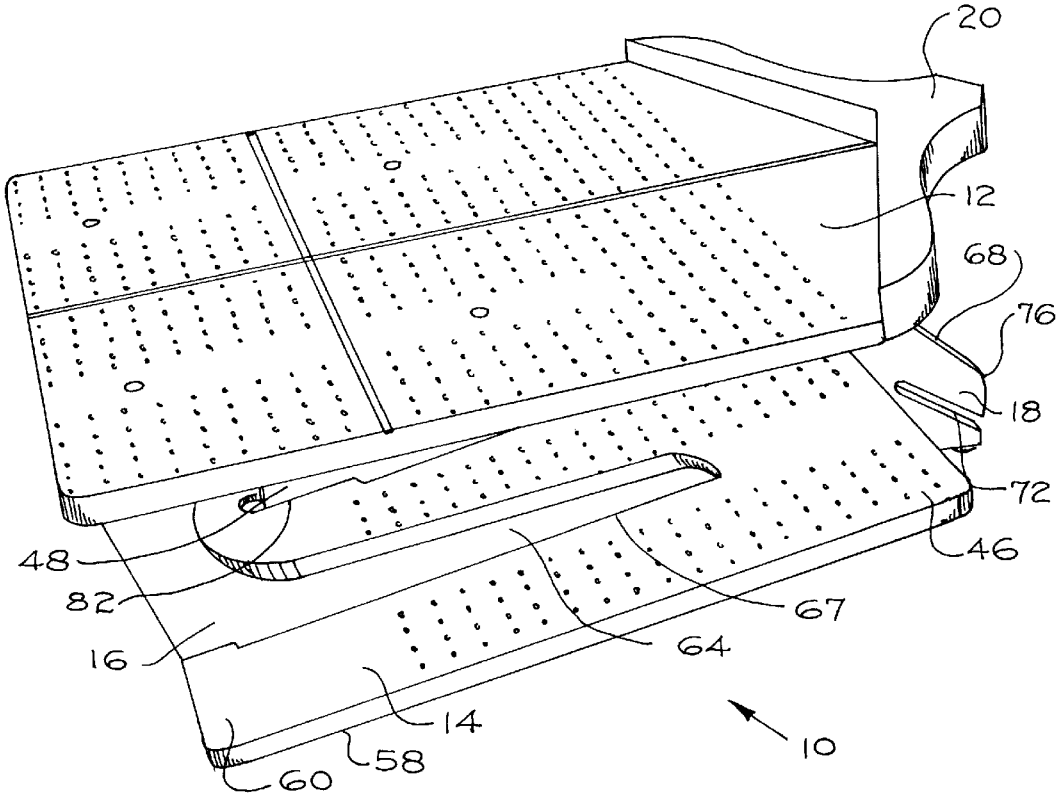
FIG. 4 is an assembled perspective view of the present invention shown in FIG. 1, with the apparatus in a third position.

As best shown in FIGS. 1, 3 and 4, the hooping apparatus 10 is preferably provided with a support leg 18 which is a generally flat member having a non-symmetric bowed upper surface or edge 68, a flat lower surface or edge 70, and two angled slots 72 and 74 located on opposite ends 76 and 78, respectively, of the support leg 18. Though the openings of both angled slots 72 and 74 preferably begin in their respective ends 76 and 78 at approximately the same height above the flat lower surface or edge 70, one angled slot 72 is angled to a larger extent with respect to the flat lower surface or edge 70 than the other angled slot 74. Both angled slots 72 and 74 are of a length, width, and depth to fit on the lower plate 14 near the connecting area 80 of the lower plate 14. For a more secure fit between the angled slots 72 and 74 and the lower plate 14, the lower plate 14 is preferably provided with a receiving groove 82 which runs from the bottom of the groove 48 between the wide and narrow legs 42, 46 of the lower plate 14 to a position within the interior of the lower plate 14. The receiving groove 82 can be located on the back side 60 of the lower plate 14 (see FIG. 1), on the front side 58 of the lower plate 14, or on both the back and front sides 60, 58 of the lower plate 14.

For purposes to be described below, when the support leg 18 is installed on the hooping apparatus 10 via the lesser-angled slot 74, the hooping apparatus 10 assumes a more reclined position (see FIG. 4) than when the support leg 18 is installed via the more steeply-angled slot 72 (see FIG. 3). By having the non-symmetric bowed upper surface or edge 68, the support leg 18 does not extend far into the area between the upper plate 12 and the lower plate 14 regardless of which angled slot 72, 74 is used to connect the support leg 18 to the lower plate 14.

Although the support leg 18 described above and illustrated in the Figures is preferred, other support legs 18 are possible and fall within the spirit and scope of the present invention. For example, the thickness of the support leg 18, the angles of the angled slots 72, 74, and the bowed upper surface or edge 68 can vary. Also, (and particularly where more than two legs 42, 46 exist on the lower plate 14 as described below), more than one support leg 18 can be employed to support the hooping apparatus 10. Even legs having different overall shapes and manners of attachment to the lower plate 14 are possible. For example, one or more legs can be pivotably mounted in a conventional fashion to the edges of the lower plate 14 to swing down from retracted positions beside the lower plate 14 to extended positions supporting the hooping apparatus 10. As another example, one or more legs can be releasably connected directly to the front side 58 of the lower plate 14 by any number of fasteners well known to those skilled in the art (i.e., secured via threaded fasteners, screwed directly into threaded holes within the lower plate, etc.). It will be appreciated by one having ordinary skill in the art that many different types of elements and/or element connectors can be used to support the hooping apparatus 10 in one or more positions. Such alternate elements and/or element connectors can be integral with or releasably connected to the hooping apparatus 10. Also, such other elements and/or element connectors can be attached, placed, or positioned in any number of manners well known in the art to support the hooping apparatus 10 in one or more inclined positions. These other elements and/or element connectors fall within the spirit and scope of the present invention.

The connectors 16 and the support leg 18 are preferably made of wood. However, it will be appreciated by one having ordinary skill in the art that many other materials are suitable for these elements, such as metal, plastic, glass, ceramics, stone, composites, combinations thereof, etc.

FIGS. 2–5 illustrate various positions in which the hooping apparatus 10 of the present invention can be placed. When a user desires to orient and hoop a garment to be worn on the torso (e.g., a sweater, shirt, jacket, vest, etc.), or when a user desires to orient and hoop an object requiring a relatively large hooping space or a relatively large hoop for a large embroidery design (e.g., for designs on towels, sheets, drapes, etc.), the upper plate 12 is preferably used, and the hooping apparatus 10 is placed upon a surface with the upper plate 12 facing upwards and with the support leg 18 installed. When a user desires to orient and hoop objects easily fitted over the wide leg 42 or the narrow leg 46 (e.g., a pant leg, a shirt sleeve, a bag, infant clothing, etc.), the lower plate 14 is preferably used, and the hooping apparatus 10 is placed upon a surface with the lower plate 14 facing upwards and with the support leg 18 removed.

Figure 2:
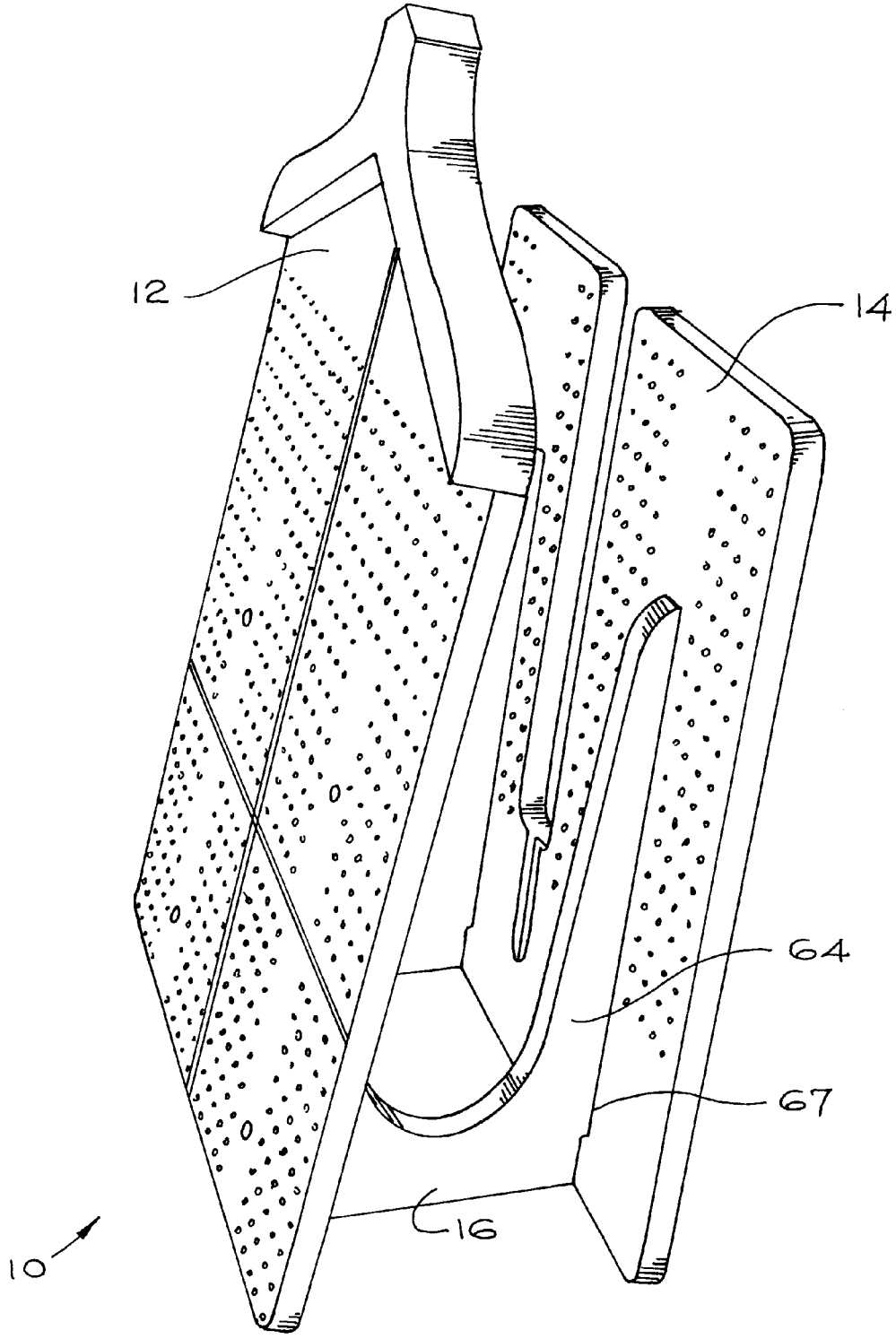
FIG. 2 is an assembled perspective view of the present invention shown in FIG. 1, with the apparatus in a first position.

The hooping apparatus 10 can preferably be placed in any of three possible positions when the upper plate 12 is in use. Each of these three positions are shown in FIGS. 2–4. The hooping apparatus 10 can preferably also be placed in a fourth position when the lower plate 14 is in use. This fourth position is shown in FIG. 5.

For objects which are best oriented and hooped when draped over the shoulder form 20 (e.g., sweaters, shirts, jackets, vests, etc.), the hooping apparatus 10 is preferably first placed in the position shown in FIG. 2. The object is then draped over the upper plate 12 and the shoulder form 20, with the side of the object to be hooped draped over the front side 32 of the upper plate 12 and with the opposite side of the object being draped between the upper plate 12 and the lower plate 14. After being properly oriented upon the upper plate 12 and the shoulder form 20, the hooping apparatus 10 is then preferably placed in the hooping position shown in FIG. 3, with the support leg 18 being inserted on the lower plate 14 via the steep angled slot 72. In this position, the upper plate 12 is inclined to a convenient and comfortable working angle in which the hooping process can be performed. Preferably, this angle is 27.0 degrees from horizontal.

For objects which are best oriented and hooped when on a large slightly inclined surface (e.g., towels, sheets, drapes, etc.), the hooping apparatus 10 is preferably placed in the position shown in FIG. 4, with the support leg 18 being inserted on the lower plate 14 via the low angled slot 74. In this position, the upper plate 12 is inclined to a lesser angle than that shown in FIG. 3 in order to prevent the objects being oriented and hooped from sliding and/or falling down the front side 32 of the upper plate 12. Preferably, the angle of the upper plate 12 in FIG. 4 is 8.0 degrees from horizontal.

For objects which are best oriented and hooped on a smaller surface (such as shirt sleeves, pant legs, bags, infant clothing, etc.), the hooping apparatus 10 is preferably placed in the position shown in FIG. 5, with the support leg 18 removed. In this position, the wide leg 42 and the narrow leg 46 of the lower plate 14 are preferably inclined away from the user by 7.0 degrees from the horizontal.

As suggested above, the dimensions of the upper plate 12 and of the wide leg 42 and the narrow leg 46 are largely determined by the types of objects which are to be oriented and hooped upon the hooping apparatus 10. The preferred widths (designated W1, W2, and W3) of the upper plate 12, wide leg 42, and narrow leg 46, respectively, also vary depending upon the size of the objects to be oriented and hooped (which itself is determined by the size of the user who will wear the garment). Therefore, the hooping apparatus 10 for orienting and framing adult-sized garments preferably has an upper plate width W1 of 15½"(15.5 inches; 39.4 cm), a wide leg width W2 of 7½" (7.5 inches; 19.1 cm), and a narrow leg width W3 of 6" (6.0 inches; 15.2 cm). A hooping apparatus 10 for orienting and framing child-sized garments can have, for example, an upper plate width W1 of 13¼" (13.25 inches; 33.7 cm), a wide leg width W2 of 6½" (6.5 inches; 16.5 cm), and a narrow leg width W3 of 5" (5.0 inches; 2.7 cm). Other widths are possible depending upon the anticipated garment and object sizes to be oriented and hooped upon the hooping apparatus 10. Similarly, other angles of inclination for each hooping apparatus position shown in FIGS. 2–5 are possible and depend upon the desired orienting and hooping angles of the upper and lower plates 12, 14. It will be appreciated by one having ordinary skill in the art that because the preferred overall size, proportions, and angles of the present invention can differ from user to user and for different hooping projects performed by the same user (a hooping apparatus 10 designed for adult-sized garments versus a hooping apparatus 10 designed for child-sized garments) several different arrangements and proportions of the present invention are possible. However, such different arrangements and proportions fall within the spirit and scope of the present invention.

It should be noted that by virtue of the side-by-side orientation of the wide leg 42 and the narrow leg 46 of the lower plate 14, it is possible to place many hoop types across the groove 48 which separates the two legs 42, 46. This presents a particular advantage when using large hoops and/or hoop brackets to hoop items (e.g., shirt sleeves or pant legs) on the wide leg 42 or the narrow leg 46 of the lower plate 14. For example, many conventional hoops (such as tubular hoops), require a large amount of space to be secured upon a surface. Such hoops cannot easily be mounted on a small or narrow surface without shifting or rotating in place. Therefore, a distinct advantage is presented by the hooping apparatus 10 of the present invention by providing a relatively small surface (wide leg 42 and narrow leg 46) to which can be securely mounted hoops and hoop brackets requiring large amounts of space. Such hoops and hoop brackets can be centered on one leg while being secured on the same leg and/or the adjacent leg.

Figure 6:
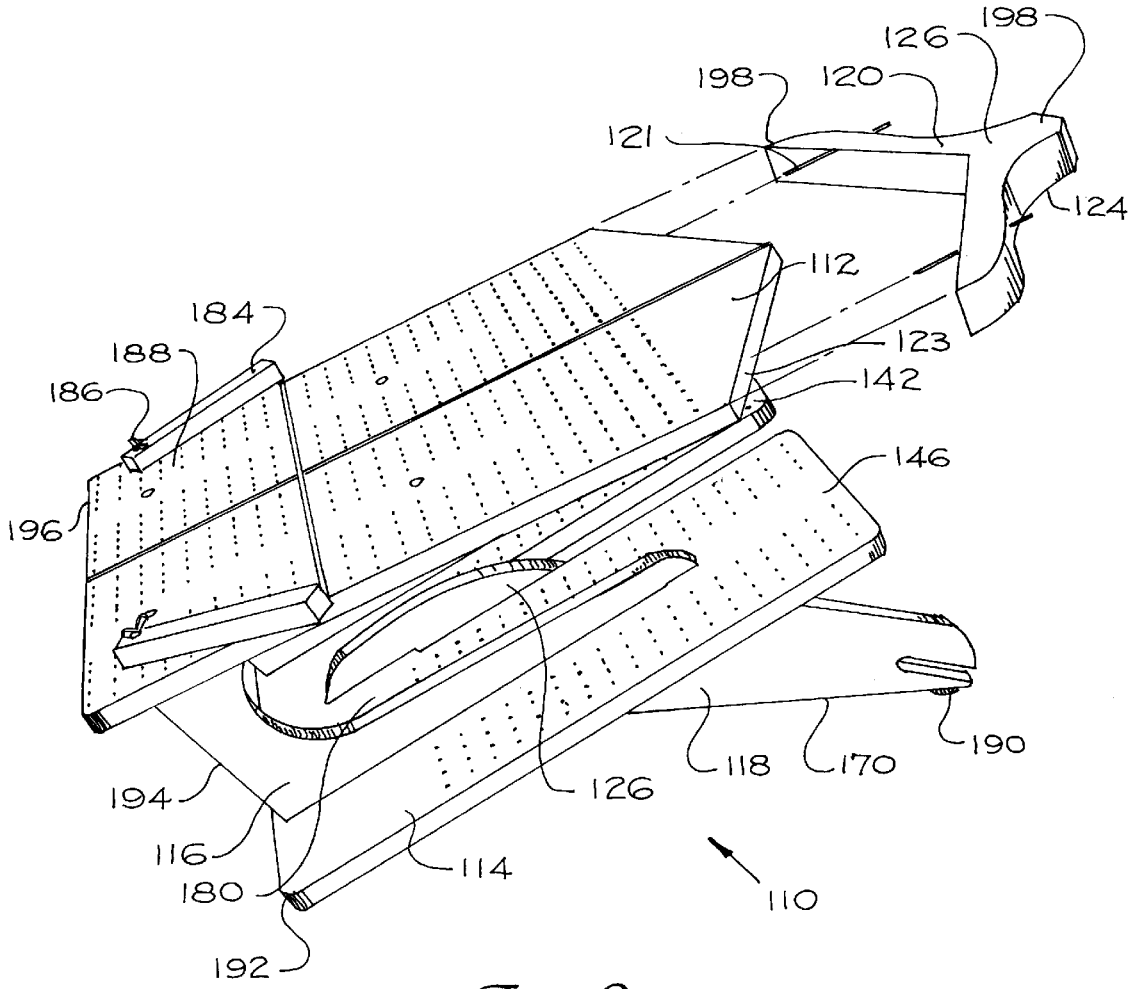
FIG. 6 is a perspective view of a second preferred embodiment of the hooping apparatus according to the present invention.

A number of optional features for the hooping apparatus of the present invention are described and illustrated with reference to the second preferred embodiment of the present invention shown in FIG. 6. The second preferred embodiment of the hooping apparatus 110 differs from the first preferred embodiment (described above and illustrated in FIGS. 1–5) in three ways.

First, the shoulder form 120 is detachable from the upper plate 112. Preferably, the shoulder form 120 is provided with two threaded fasteners 121 which are passed through the shoulder form 120 and into threaded holes (not shown) in the upper edge 123 of the upper plate 112. The shoulder form 120 has a front surface 124 and a rear surface 126 both preferably shaped to support a torso garment in a manner similar to how the garment would drape over a user. When the user wishes to switch between orienting and hooping operations on the front and back of a torso garment, the user loosens the threaded fasteners 121, removes the shoulder form 120, reverses its orientation with respect to the upper plate 112, and then attaches the shoulder form 120 back on to the upper plate 112 using the threaded fasteners 121. The ability of a user to remove and reverse the placement of the shoulder form 120 on the upper plate 112 permits the user to use the upper plate 112 to perform orienting and hooping operations both on the front and back of torso garments which are accurately hung in both positions.

The possible shape, material, and proportions of the shoulder form 120 are the same as those described for the shoulder form 20 of the first preferred embodiment. Also, the number and types of fasteners used to removably attach the shoulder form 120 to the upper plate 112 vary widely. For example, the shoulder form 120 can be attached to the upper plate 112 via one centrally placed threaded fastener (not shown). By loosening this fastener, the shoulder form 120 can be rotated in place to change the position of the shoulder form 120 on the upper plate 112. Alternately, more threaded fasteners can be used in the same or different locations shown in FIG. 6. Also, the shoulder form 120 can instead be attached by dowels (not shown) which are press fit into mating holes with the upper edge 123 of the upper plate 112. Other fasteners (such as clips attached to the surface and/or sides of the upper plate 112 and the shoulder form 120, etc.) and fastening methods (such as a press-fit tongue and groove rather than dowels and holes, etc.) are possible to removably attach the shoulder form 120 to the upper plate 112. The shoulder form 120 can even be secured (in a releasable or non-releasable fashion) to the upper plate 112 via one or more hinges, ball-and socket joints, swivel joints, or any other movable connections (not shown) to permit the angle and orientation of the shoulder form 120 to be adjustable. Such other manners of connection are well known to those skilled in the art and are not therefore discussed further herein.

Second, the hooping apparatus 110 is preferably provided with two arms 184 which are pivotably mounted via arm fasteners 186 to the lower portion 188 of the upper plate 112. The arms 184 are preferably releasable by loosening the arm fasteners 186, and can be rotated from positions parallel to the length of the upper plate 112 to positions directed away from the upper plate 112 as shown in FIG. 6. The arms 184 are used to spread an object to be oriented and hooped after it has been draped over the upper plate 112. This process ensures that certain objects (such as jackets having an elastic waistband) are properly spread across the upper plate 112 during the orienting and hooping process. The arms 184 can take any shape (which achieves the purpose of spreading material draped over the upper plate 112), and can be made of any substantially rigid material, such as wood, metal, plastic, glass, ceramics, composites, stone, combinations thereof, etc. Also, the arm fasteners 186 are preferably threaded fasteners and wing nuts, but can take any number of forms well known to those skilled in the art.

Third, the hooping apparatus 110 is preferably provided with pads 190 which are preferably located on the flat lower surface or edge 170 of the support leg 118. The pads 190 are preferably made of a non-slip material such as rubber, and prevent the hooping apparatus 110 from sliding across a support surface during orienting and hooping operations. The pads 190 are preferably secured in a conventional manner to the flat lower surface or edge 170 by threaded fasteners, nails, glue, etc. (not shown). Though two pads 190 are shown located on the flat lower surface or edge 170 of the support leg 118, fewer or more pads 190 of almost any shape and size can be secured on different areas of the hooping apparatus 110 which contact a support surface during orienting and hooping operations. For example, pads 190 can be located on the lower surface or edge 192 of the lower plate 114, on the lower surface or edge 194 of the connectors 116, on the lower surface or edge 196 of the upper plate 112, and/or on the upper surface or edge 198 of the shoulder form 120.

The embodiments disclosed above and illustrated in the figures are presented by way of example only and are not intended as a limitation upon the concepts and principles of the present invention. For example, although only two legs 42, 46, 142, 146 are shown on the lower plate 14, 114, more or fewer legs can be employed. In the event that only one leg 42, 46, 142, 146 is used along with the preferred support leg 18, 118 arrangement as described above and shown in the Figures, the lower plate 14, 114 is preferably provided with an area similar to the connecting area 80, 180 of the lower plate 14, 114 on which the support leg 18, 118 can engage. Use of only one support leg or more than two support legs can impact the design choices for the number, placement, and sizes of the connectors 16, 116.

It will be appreciated by one having ordinary skill in the art that various changes in the elements and their configuration and arrangement are possible without departing from the spirit and scope of the present invention as set forth in the appended claims.

Having thus described the invention, what is claimed is:

1. An embroidery hooping apparatus comprising:

a first plate;

a second plate;

a connector connecting the first and second plates in facing relationship with one another; and an adjustable support leg supporting the embroidery hooping apparatus in at least two positions corresponding to different inclined positions of the first plate and the second plate.

2. The embroidery hooping apparatus as claimed in claim 1, wherein the embroidery hooping apparatus has a third position unsupported by the adjustable support leg, the first plate and the second plate being more steeply inclined in the third position than in the at least two embroidery hooping apparatus positions.

3. The embroidery hooping apparatus as claimed in claim 1, wherein the embroidery hooping apparatus has an inverted position in which the second plate is located substantially above the first plate.

4. The embroidery hooping apparatus as claimed in claim 1, wherein the second plate has at least two legs each defining a substantially flat and elongated work surface.

5. The embroidery hooping apparatus as claimed in claim 4, wherein at least one of the legs has a distal end with a non-rectangular shape.

6. The embroidery hooping apparatus as claimed in claim 4, wherein the second plate has two legs and wherein the second plate is substantially U-shaped with the two legs being located in a substantially side-by-side parallel relationship.

7. The embroidery hooping apparatus as claimed in claim 1, wherein the adjustable support leg is connected to the second plate.

8. The embroidery hooping apparatus as claimed in claim 7, wherein the adjustable support leg has at least two slots formed therein, the embroidery hooping apparatus assuming a first of the at least two positions when the adjustable support leg is connected to the second plate via one of the at least two slots, the embroidery hooping apparatus assuming a second of the at least two positions when the adjustable support leg is connected to the second plate via a second of the at least two slots.

9. The embroidery hooping apparatus as claimed in claim 1, wherein the first and second plates each have a plurality of apertures formed therein, the plurality of apertures being sized and shaped to receive hoop fasteners.

10. The embroidery hooping apparatus as claimed in claim 1, further comprising a shoulder form located at one end of the first plate.

11. The embroidery hooping apparatus as claimed in claim 1, wherein one end of the first plate has two upwardly-converging portions defining shoulder portions of the first plate.

12. The embroidery hooping apparatus as claimed in claim 10, wherein the shoulder form is releasably attached to the first plate in a first and a second position, the shoulder form having an upper surface and a lower surface shaped to drape garments placed thereover in a front and a back human torso position corresponding to the first and second positions of the shoulder form, respectively.

13. The embroidery hooping apparatus as claimed in claim 1, wherein the connector is U-shaped with a base and two legs, the base of the connector being located near opposing and facing ends of the first and second plates to define a substantially unobstructed area between the first and second plates.

14. An embroidery hooping apparatus comprising:

a first plate having an upper surface and a lower surface;

a second plate having an upper surface and a lower surface;

at least one connector connecting the lower surface of the first plate to the lower surface of the second plate in a substantially facing relationship; and at least one support leg supporting the embroidery hooping apparatus in a first support position in which the first and second plates are in respective first reclined positions and a second support position in which the first and second plates are in respective second reclined positions.

15. The embroidery hooping apparatus as claimed in claim 14, wherein the embroidery hooping apparatus rests upon at least one of the first plate, the second plate, and the connector to support the embroidery hooping apparatus in a third support position, the first and second plates being in respective third reclined positions when the embroidery hooping apparatus is in the third support position.

16. The embroidery hooping apparatus as claimed in claim 14, wherein the first plate lies substantially over the second plate in the first and second reclined positions and wherein the embroidery hooping apparatus has an inverted position in which the second plate is positioned substantially over the first plate.

17. The embroidery hooping apparatus as claimed in claim 16, wherein the second plate has at least two legs each defining a substantially flat and elongated work surface.

18. The embroidery hooping apparatus as claimed in claim 17, wherein the second plate has two legs connected at one end to lie in a side-by-side relationship.

19. The embroidery hooping apparatus as claimed in claim 14, wherein the at least one support leg is releasably connectable to the embroidery hooping apparatus in two locations on the at least one support leg, each of the two locations corresponding to either the first support position or the second support position.

20. The embroidery hooping apparatus as claimed in claim 19, wherein the at least one support leg has a first and a second angled groove formed therein, the second plate being received in the first groove to support the embroidery hooping apparatus in the first support position, and the second plate being received in the second groove to support the embroidery hooping apparatus in the second support position.

21. The embroidery hooping apparatus as claimed in claim 14, further comprising a shoulder form located at one end of the first plate, the shoulder form having at least two upwardly-converging sloped surfaces.

22. The embroidery hooping apparatus as claimed in claim 14, wherein one end of the first plate has two edges which are sloped in converging directions.

23. A method of using an embroidery hooping apparatus having upper and lower plates oriented one beside the other, connected by at least one connector, and selectably supported upon a surface by a support leg having a first supporting position and a second supporting position, the method comprising the steps of:

placing the embroidery hooping apparatus on the surface in a first working position supported by the support leg in the first supporting position and in which the upper and lower plates are oriented in respective first directions to orient articles for hooping in a first orientation with respect to the surface; and adjusting the support leg from the first supporting position to the second supporting position to orient the upper and lower plates in respective second directions defining a second working position in which articles to be hooped are oriented in a second orientation with respect to the surface.

24. The method as claimed in claim 23, further comprising the steps of:

turning the embroidery hooping apparatus over to an inverted working position; and placing the embroidery hooping apparatus on the surface in the inverted working position.

25. The method as claimed in claim 23, wherein the first directions of the upper and lower plates define respective first acute angles of the upper and lower plates with respect to a fully vertical position, wherein the second directions of the upper and lower plates define respective second angles of the upper and lower plates with respect to a fully vertical position, and wherein the third directions of the upper and lower plates define respective third angles of the upper and lower plates with respect to a fully vertical position, the second angles being larger than the first acute angles and the third angles being larger than both the first acute angles and the second angles.

26. The method as claimed in claim 23, wherein the support leg is removable from the embroidery hooping apparatus and is engageable in at least two positions corresponding to at least the first supporting position and the second supporting position.

* * * * *